US007112145B2

(12) United States Patent
Gaddy

(10) Patent No.: US 7,112,145 B2
(45) Date of Patent: Sep. 26, 2006

(54) GOLF TRAINING DEVICE

(76) Inventor: Mark Gaddy, 3010 Meriweather Lewis Trail, Monroe, NC (US) 28110

( * ) Notice: Subject to any disclaimer, the term of this patent is extended or adjusted under 35 U.S.C. 154(b) by 0 days.

(21) Appl. No.: 11/292,925

(22) Filed: Dec. 2, 2005

(65) Prior Publication Data

US 2006/0122001 A1 Jun. 8, 2006

Related U.S. Application Data

(60) Provisional application No. 60/632,895, filed on Dec. 3, 2004.

(51) Int. Cl.
*A63B 69/36* (2006.01)

(52) U.S. Cl. ..... 473/220; 473/218; 473/219

(58) Field of Classification Search ..... 473/219, 473/220, 221, 222, 266, 268
See application file for complete search history.

(56) References Cited

U.S. PATENT DOCUMENTS 5,472,204 A * 12/1995 English et al. ..... 473/220
5,818,036 A * 10/1998 Daly ..... 250/216
6,007,436 A 12/1999 Mark
6,213,887 B1 * 4/2001 Carney ..... 473/183
6,736,735 B1 * 5/2004 Galanis et al. ..... 473/221
2005/0096146 A1 * 5/2005 Burley ..... 473/270

* cited by examiner

*Primary Examiner*—Nini F. Legesse
(74) *Attorney, Agent, or Firm*—Dougherty Clements; F. Rhett Brockington

(57) ABSTRACT

A golf training device that assists a golfer in sighting the direction to hit, and in the proper alignment of his body with respect to the golf ball. The device has a housing for mounting at least two lasers having a vertical element that provides vertical support for the lasers, a base element that enables at least a portion of the housing to be oriented to a desired sighting, and a spike for stabilizing the housing. Each of the lasers has a diffraction optical element that converts a laser beam into a planar arc of light which when projected onto a surface, such as the ground, produces a laser line. The diffraction optical elements are oriented orthogonal to each other and the resulting lines produced by the lasers are orthogonal. One of the laser lines provides feet alignment and the other provides a feet to ball laser reference line.

20 Claims, 6 Drawing Sheets

GOLF TRAINING DEVICE

CROSS-REFERENCE TO RELATED PATENT APPLICATIONS

The Application claims the benefit of the priority filing date of the U.S. provisional patent application filed on Dec. 3, 2004, bearing the Ser. No. 60/632,895.

BACKGROUND OF THE INVENTION

1) Field of Invention

The invention relates to a golf training aid, and more particularly to a training device that enables a golfer to accurately determine the direction in which a golf ball will be hit when properly struck, and an aid that assists the golfer in properly aligning his feet with respect to the ball.

2) Prior Art

In playing the game of golf, a golfer must properly align his body with respect to the ball to accurately hit it to a desired location on the course. It is not easy for the golfer to position his stance such that the alignment is attained. There have been recent advances using laser technology that help a golfer align his position with respect to the ball, and with respect to the desired direction that the golfer wishes to hit the ball. In U.S. Pat. No. 6,007,436 to Phillip Mark, there is disclosed a method for employing light from a laser light beam source to assist in aiming a golf ball and device therefor. In the invention the golfer holds the laser light beam source directly over the golf ball and rotates the source until the golfer believes that it is pointed toward the desired direction. The source creates three lines on the ground. A first line bisects the ball and points in the direction that the golfer wishes to hit the ball. A second line is parallel to the first line, so that the golfer can align his feet. A third line is orthogonal to the first line and the second line, such that the shaft of the club can be aligned substantially parallel with the third line.

A limitation of Phillip Mark's invention is that the golfer must accurately rotate the device over the ball so that the first light beam is accurately pointed in the desired direction. A second limitation is that the second line, which helps the golfer align his feet, is a function of the height at which the golfer holds the laser-training device. The higher the device, the greater the distance between the first line and the second line; and in order to achieve reproducible results, the golfer must always hold the light beam device at the same height. A third limitation is that, as shown, the lines are only created while the golfer is holding the laser light beam source. As soon as the golfer picks up his club to hit the ball, then he must put down or pocket the laser light beam source. Another limitation is that the golfer has to move with respect to the ball (versus the conventional method of training where the golfer positions the ball), and the invention doesn't relate the position of the ball with the position of the golfer's lead foot. An advantage of Phillip Mark's invention is that it is portable and can be easily transported to the golf course or the driving range.

What is needed is a training device that does not require the golfer to hold the device when addressing the ball, where the training device can be set up and/or teed into the ground in a stationary position, and therein produces a feet alignment directional laser line. The feet alignment directional laser line can then be adjusted by sighting down the line, and rotating the device such that the line has the desired coincident orientation. Furthermore, what is needed is a training device that in applications where the ball has a fixed position (e.g. a driving range), the feet alignment directional laser line can be adjusted such that the distance from the ball to the feet alignment laser line is adjustable to accommodate clubs having different shaft lengths, and people having different dimensions and styles of play (i.e., tall or short, and how much they are comfortable leaning forward or standing upright). Further, what is needed is a feet to ball laser line that is orthogonal to the feet alignment directional laser line, where the feet to ball laser line provides the golfer a stationary visible reference to properly align his feet, and in particular his lead foot, with respect to the golf ball. The feet to ball laser line should provide a reference where the golfer will know that for any given club what is the desired position of the ball with respect to the feet to ball laser line. For instance, for a driver the ball is typically in front of the front of the feet to ball laser line, and consequently close to the golfer's lead foot toe, and for a fairway wood the ball is typically on or behind the feet to ball laser line, and consequently further back and closer to the golfer's heel.

Another desired feature of the training device is that it can be used to quantify the golfer's club head speed, as the club head speed is strongly indicative of the distance the struck ball will travel.

SUMMARY OF THE INVENTION

The invention is a golf training device to assist a golfer in sighting a direction for hitting a golf ball, and to also assist the golfer in aligning his body with respect to the ball. The training device is comprised of a housing for mounting at least two lasers. The device is preferably portable, and is powered by a battery source, and is positioned in front of a golfer addressing the ball or preparing to address the ball. The housing is comprised of a vertical element that provides vertical support for the lasers, a base element that enables at least a portion of the housing to be rotated to a desired sighting, and a spike for stabilizing the housing. Each laser has an optical element, such as a diffraction gradient, where the optical element fans the laser beam into a laser line that is visible as a projection onto the ground. A first laser, having a first axial element, projects a feet alignment directional laser line at a desired distance from the device, where the feet alignment directional laser line is aligned with the desired sighting by rotating the device to a direction coincident with the desired sighting. The angle of the first laser with respect to the ground is adjusted, using the first axial element, until the feet alignment directional laser line is formed at the desired distance from the device. The greater the distance, the greater the length of the feet alignment directional laser line. The length should be at least as long as the width of the golfer's stance. A golfer will typically lock the first axial element on the first laser, so axial movement, and the length, are set. The device has a second laser having an optical element that projects another laser line, a feet to ball laser line that is orthogonal to the feet alignment directional laser line. Similar to the first laser, the second laser also has a second axial element or shares a common first axial element. Preferably, the first and second lasers are on opposing sides of the housing, as to prevent any obstruction to the laser. The second laser has a substantially vertical orientation such that the planar arc of light emanating from the second optical element has a substantially vertical orientation with respect to the ground. The feet to ball laser line is sufficiently long to extend from the ball to the heel of the golfer's shoes. The feet to ball laser line provides a general reference of where the ball is in relationship to the golfer's feet. The positioning of the device, the angle of the laser, the height of the laser, and the diffractive characteristics of the second optical element can influence the length of the feet to ball laser line.

Generally speaking, the device is setup or teed-up either between the golfer and the ball or at a point outside of the radius of the arc of the golfer's swing. The device can be fitted with a third laser having an orientation similar to the first laser, except that the third laser projects a lighted line image that is parallel to the feet alignment directional laser line, where the lighted line image is at a distance from the device such that the lighted line image bisects the reference point for the ball. It is anticipated that additional lasers can be added, and that these lasers project could project additional ground images that would be instructive to the golfer.

The invention is further comprised of a remote laser light detector module that can measure the speed of a club head at the point of impact with a golf ball. The module, working in concert with the second laser, detects when and for how long the vertical plane of light forming the feet to ball laser line is broken. Using the dimensions of the golf club the module can then calculate the club head speed at impact.

BRIEF DESCRIPTION OF THE DRAWINGS

The foregoing and other objects will become more readily apparent by referring to the following detailed description and the appended drawings in which.

DETAILED DESCRIPTION

Figure 1:
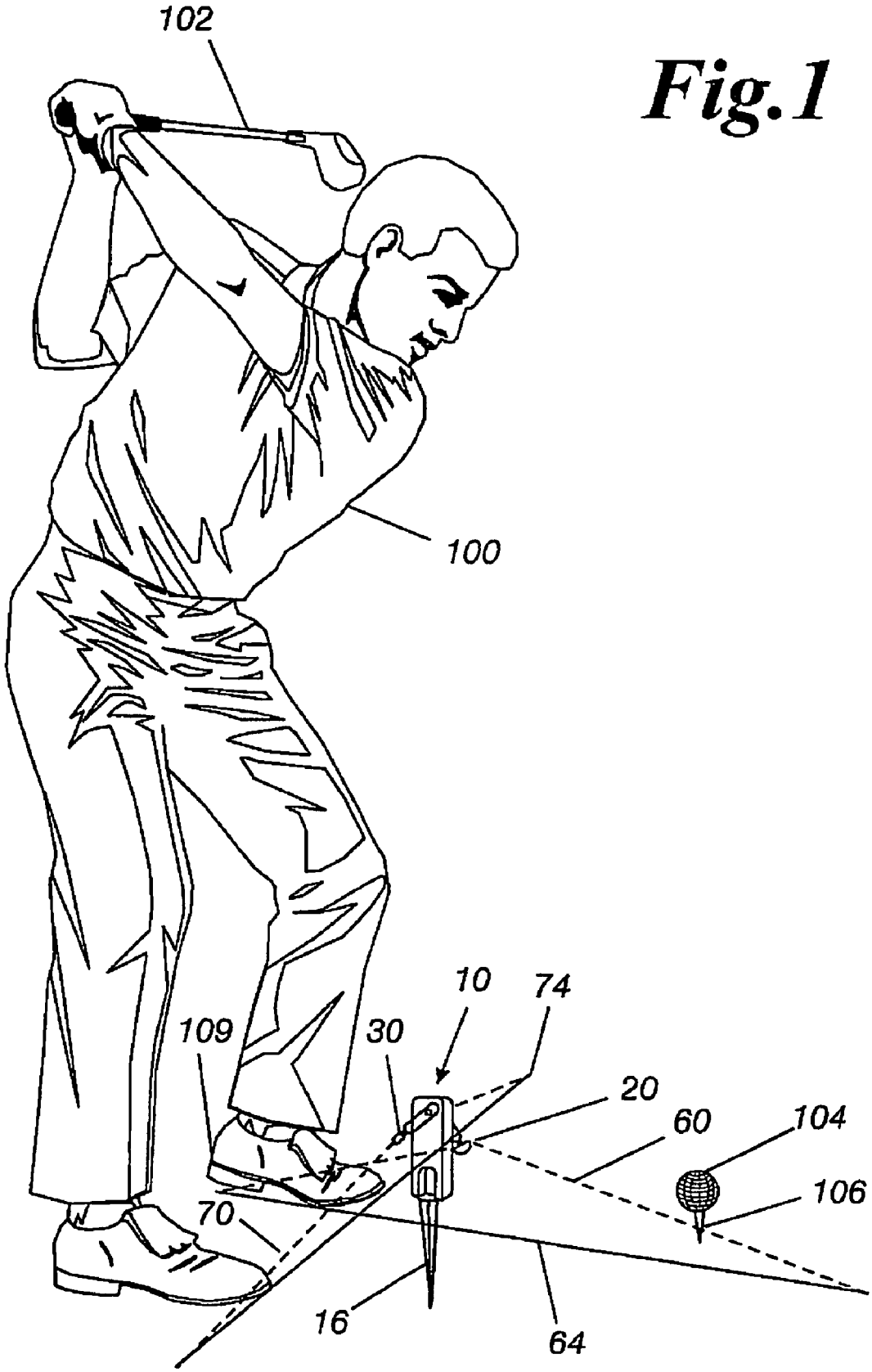
FIG. 1 is a perspective view of a right-handed golfer preparing to hit, wherein the training device 10 is projecting a feet alignment directional laser line 74 that points toward the desired direction of flight, and a feet to ball laser line 64, which aids the golfer in aligning his position with respect to the golf ball. The training device 10 is positioned inside the arc of the golfer's swing.
Figure 2:
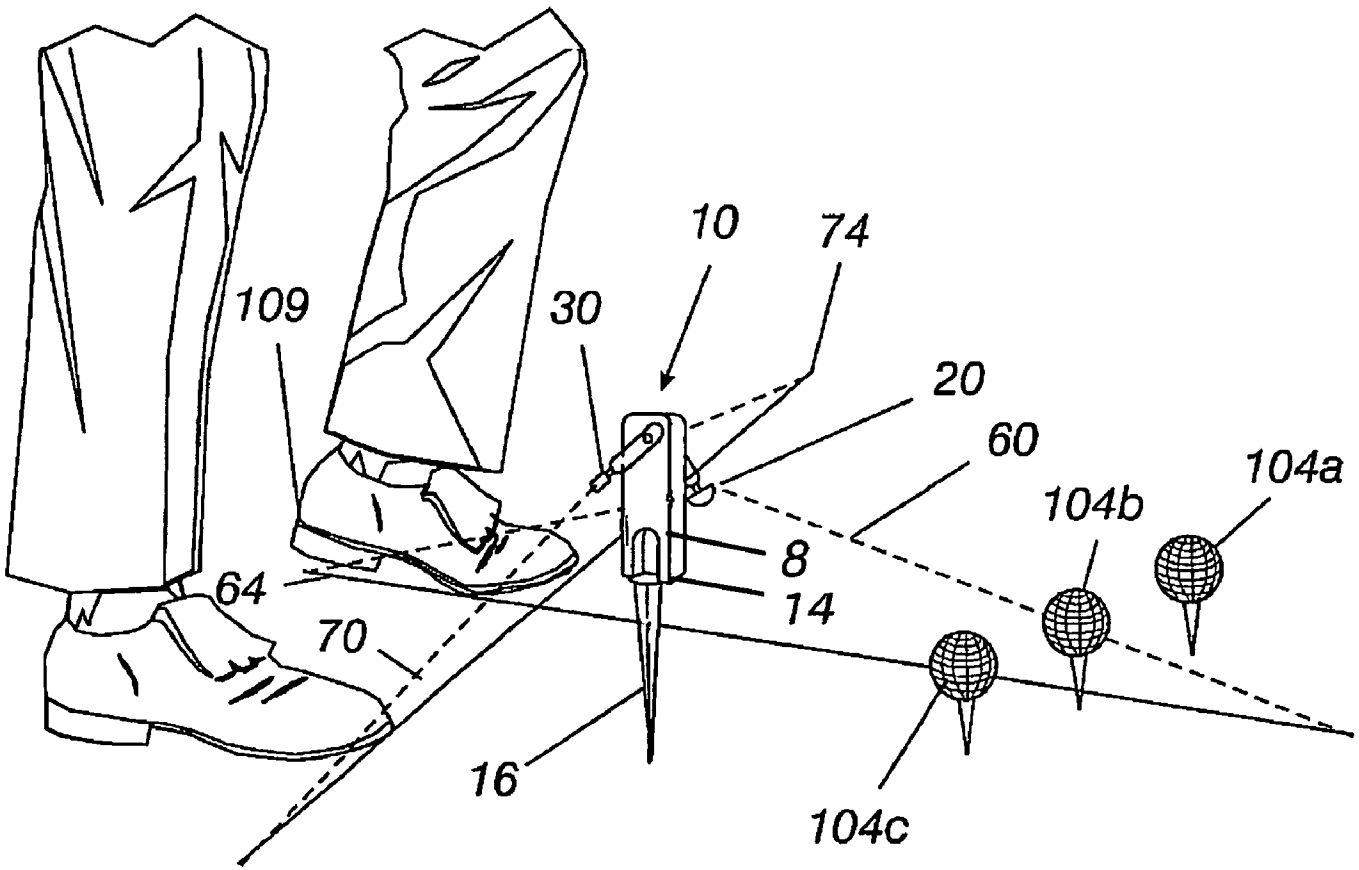
FIG. 2 is an enlarged view of the right-handed golfer illustrated in FIG. 1, wherein the lasers are mounted on opposing sides of the housing, and wherein a dashed line indicates a plane of light emanating from an optical element.
Figure 3:
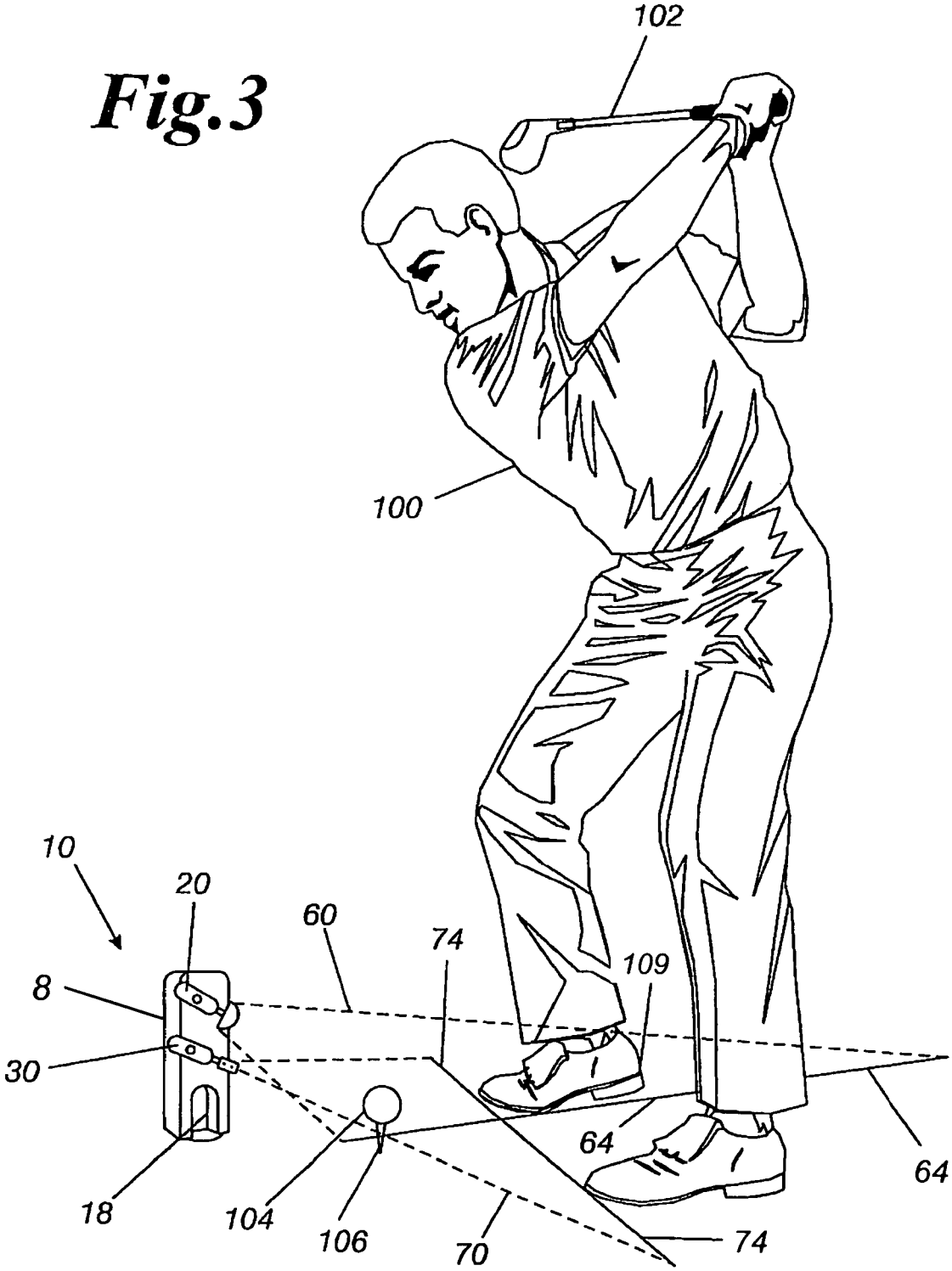
FIG. 3 is a perspective view of a left-handed golfer preparing to hit, wherein the training device is projecting a feet alignment directional laser line 74 that points toward the desired direction of flight, and a feet to ball laser line 64, which aids the golfer in aligning his position with respect to the golf ball. The training device 10 is positioned outside the arc of the golfer's swing
Figure 5:
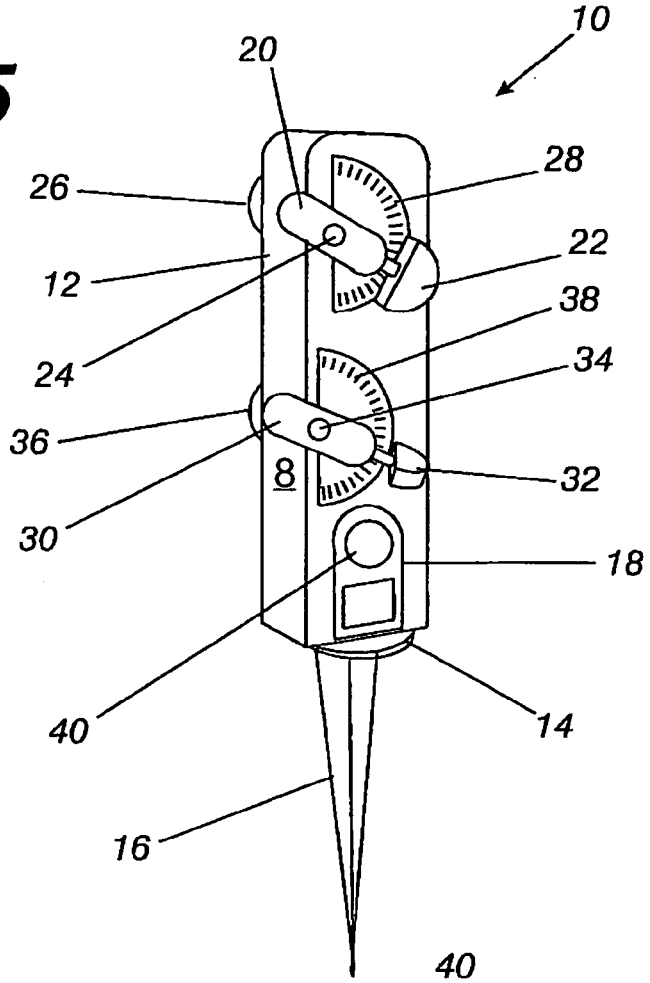
FIG. 5 is a perspective view of an embodiment of the golf training device illustrated in FIG. 1 and FIG. 2, wherein the lasers are mounted on the same side of the housing and the housing is additionally equipped with indicia to indicate the projection angle of the two lasers, where the lasers are projecting the feet alignment directional laser line and the feet to ball laser line on the ground in front of the golfer.

FIG. 5 is a perspective view of the golf training device 10, wherein the lasers are mounted on the housing 8. In contrast to the golf training device illustrated in FIG. 1 and FIG. 2, the lasers 20 and 30 are optionally mounted on the same side of the housing. The housing 8 is comprised of a vertical element 12 that provides vertical support for the lasers 20 and 30, a base element 14, and a spike 16 for stabilizing the housing. The base element 14 can be a flange as shown in FIG. 5, or merely be the bottom of the vertical element 12 as shown in FIG. 2. The spike 16 can be of sufficient length to add height to the device 10, as shown in FIG. 1, or to be just long enough to easily penetrate into the ground, as shown in FIG. 3, so that the base is flush with the ground. The first laser 30 has an optical element 32 that projects a plane of light 70 that produces a feet alignment directional laser line 74 on the ground, as shown in FIGS. 1–3. The first laser 30 can be angularly adjusted on an axial element, (i.e. bolt) 34, and tightened using thumbscrew 36. The angle can be measured using in degrees using a series of indicia markings 38 on the housing 8. The first laser 30 provides a laser line for sighting as well as aligning the golfer's feet substantially a right angle to the desired sighting. The second laser 20 has an optical element 22 that projects a plane of light 60 that is orthogonal to the first plane of light 70, and produces a feet to ball laser line 64 on the ground, as shown in FIGS. 1–3. The second laser 20 can be angularly adjusted on an axial element, (i.e. bolt) 24, and tightened using thumbscrew 26. The angle can be measured using in degrees using a series of indicia markings 28 on the housing 8. The second laser 20 has a substantially vertical orientation such that the planar arc of light 60 emanating from the second optical element 22 has a substantially vertical orientation with respect to the ground. The optical elements 22 and 32 are diffraction gradients that convert the laser beam into a planar arc of light. The feet to ball laser line 64 is sufficiently long to extend from the ball 104 to the heel 109 of the golfer's shoes. The feet to ball laser line 64 provides a general reference of where the ball is in relationship to the golfer's feet. As shown in FIG. 2, the golf ball 104*a* can be in front of line 64, the golf ball 104*b* can be on line 64, or the ball 104*c* can be behind the line. A golfer 100 using a driver 102 would typically have the ball 104 on a tee 106 that was slightly in front of the feet to ball laser line 64. The housing 8 is preferably fitted with a socket 18, as shown in FIG. 5, for receiving and protecting a remote laser light detector module 40.

Figure 4:
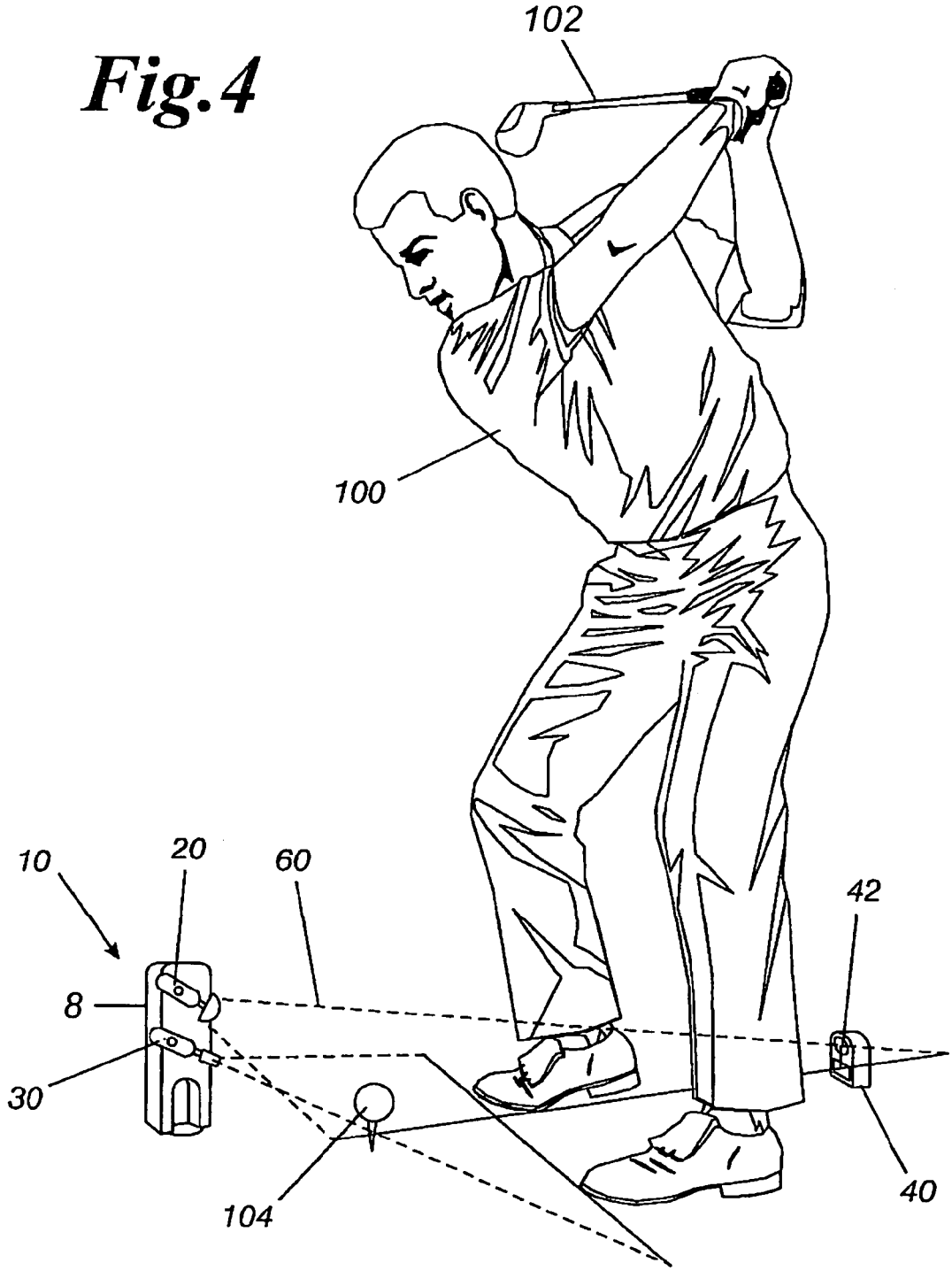
FIG. 4 is a perspective drawing similar to FIG. 3, wherein the golfer is additionally utilizing a remote laser light detector module that measures the speed of the club head at the point of impact with the golf ball.

The golf training device 10, can be positioned between the golfer 100 and the ball 104, as shown in FIGS. 1 and 2, or outside the arc of the golfers swing, as shown in FIGS. 3 and 4.

In FIGS, 1–4 golfer 100 swinging club 102 is utilizing the golf training device 10 to sight the direction that he is going to hit the ball, and to align himself with respect to the ball 104. The vertical plane of light 60 emanating from the second laser produces a feet to ball laser line 64 onto the ground. The first laser 30 produces a planar arc of light 70 that projects on to the ground forming the feet alignment directional laser line 74 is aligned with the desired flight of the ball. Note that by changing the angle of laser 30 one can change the position of where the feet alignment directional laser line 74 is formed. The more acute the angle, the further away the second lighted line image will be from the device 10. Further, not shown, it is anticipated that a third laser could be mounted on the device, and if the optical element has the same orientation as the optical element 32, a lighted line image that is parallel to the feet alignment directional laser line would be formed, where the lighted line image is at a desired distance from the device such that it bisects the ball.

Figure 6:
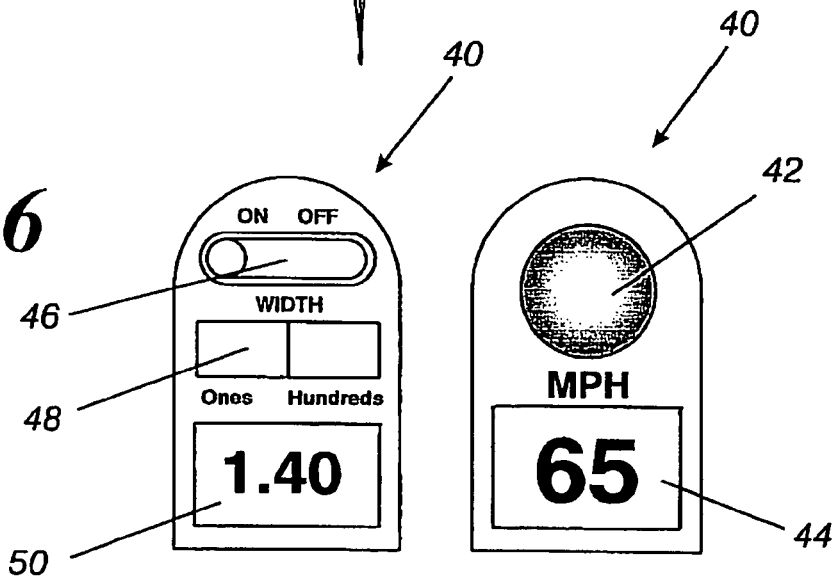
FIG. 6 is a planar view of the front of the remote laser light detector module that has an LCD readout of the club head speed, and a rear planar view of the remote laser light detector module which illustrates the controls for calibrating the module.

FIG. 4 illustrates the use of the remote laser light detector module 40 to calculate the club head speed at impact. The module 40 works on the principal that if the plane of light 60 is broken for a known period of time, then a club head speed can be calculated. In the illustrated embodiment, the module as shown in FIG. 6 has a front and a back. On the front of the module there is a photoelectric detector 42 and an LCD 44 that reads out in miles per hour (mph) the detected club head speed. On the back is a switch 46 for turning the module on and off and a rocker switch 48, which when depressed on one side increments in units of one inch, and when depressed on the right side in increments of hundredths of an inch. The LCD 50 is the readout of the numbers generated by the rocker switch 48.

Figure 7:
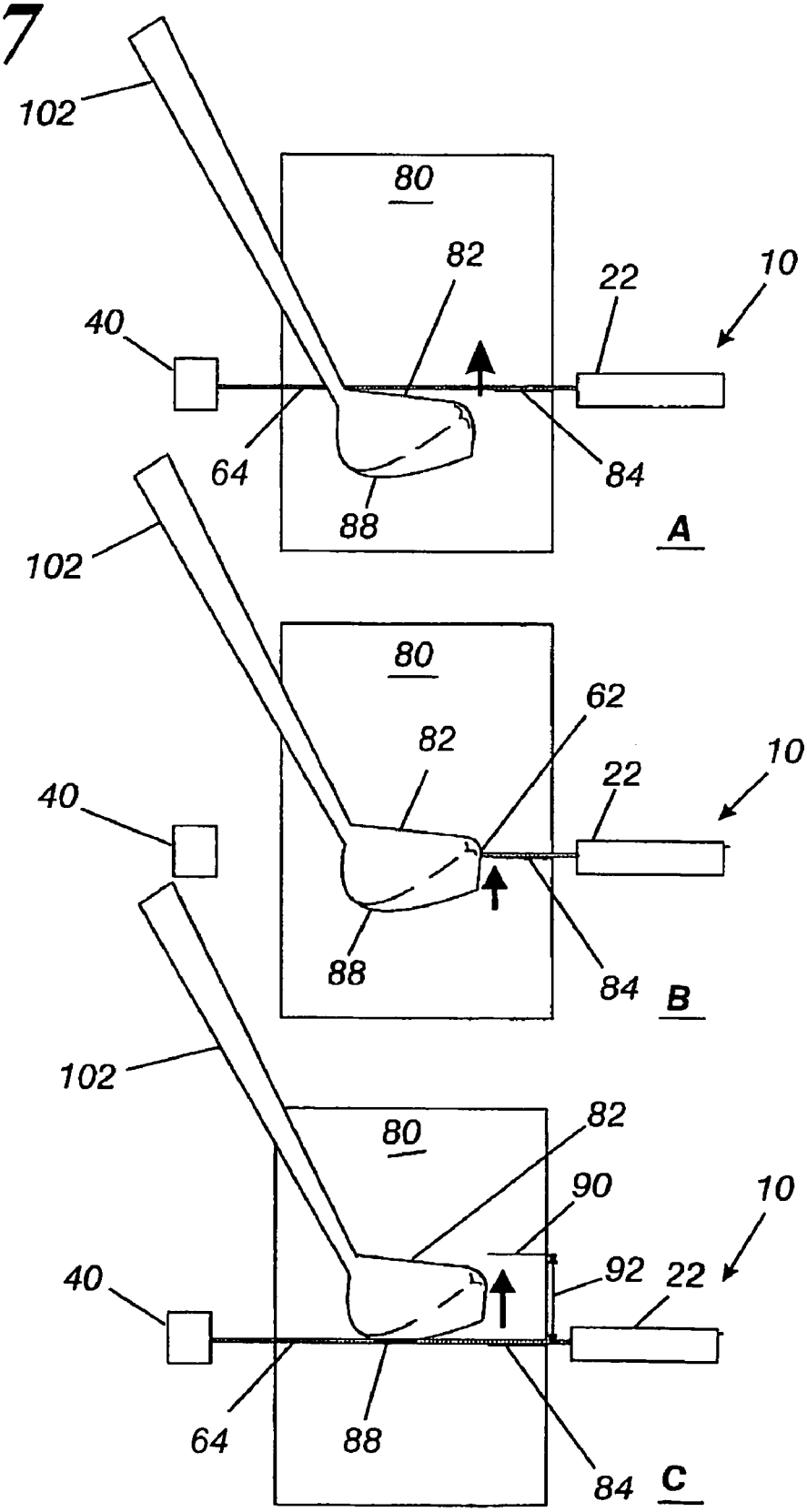
FIG. 7 is an illustration of the three steps required to calibrate the remote laser light detector module using a calibration pad 80.

In order to calculate the club head speed you must first calibrate the module 40. Calibrating module 40 is determined by the shadow of the club being swung. In FIG. 7 illustrates the calibration process. Note in FIG. 7 that the calibration is of a right-handed golfer. The module is positioned behind the golfer as shown in FIG. 4, such that substantially the vertical plane of light 60 emanating from the second laser 20 is aligned with the photodetector 42. The front edge 82 of the golf club 102 is brought up flush with the first lighted line image 62, which is projected onto the ground. In FIG. 7, to facilitate the accuracy of the measuring a calibration pad 80 is placed on the ground to make it easier to see the laser line, and to also mark the position of the club head. In FIG. 7A a tic-line 84 has been drawn on the calibration pad 80, which indicates where the laser is when the front of the club head is flush with the first lighted line 62. The club head is then advanced until it cuts through the plane 60 that shadows the photo detector 42. The club head is slowly advanced until the laser light detector module 40 can again see the first lighted line 62. The calibration pad 80 is marked with a second tic-line 90, which corresponds to the front of the club 82. The distance between the first tic-line 84 and the second line 90 is the shadow of the club head. The width of the shadow 92 is then entered into the module 40 using the rocker switch 48. The remote laser light detector module 40 is now calibrated to read out in mph 44 the club head speed for that specific club head. In many cases the shadow that is created is not a function of the actual size of the club head, but of the size of the hosel or the shaft of the club. In these cases, the module would be calibrated for all of the clubs. Table 1 contains examples that illustrate the relationship between club head speed and the width of the shadow 92 created by the club.

TABLE 1

| Time Interval (Thousandth's of a sec) | Club Length (inches) | Miles Per Hour | Club |
|---|---|---|---|
| 3.79 | 4.00 | 60.0 | One Wood |
| 3.00 | 4.50 | 85.2 | One Wood |
| 1.00 | 1.50 | 85.2 | Five Iron |
| 3.03 | 3.80 | 71.3 | Two Wood |
| 0.37 | 0.40 | 61.4 | Base of Hosel |
| 0.30 | 0.40 | 75.8 | Base of Hosel |
| 0.27 | 0.40 | 84.2 | Base of Hosel |

It is to be understood that the foregoing description and specific embodiments are merely illustrative of the best mode of the invention and the principles thereof, and that various modifications and additions may be made to the device by those skilled in the art, without departing from the spirit and scope of this invention.

What is claimed is:

1. A golf training device for assisting a golfer in sighting a direction for hitting a golf ball, and for assisting the golfer in aligning his body with respect to the ball, where said device comprises:

a housing for mounting at least two lasers, said housing comprised of a vertical element that provides vertical support for the at least two lasers, a base element that enables at least a portion of the housing to be oriented to a desired sighting, and a spike for stabilizing the housing;

a first laser having an optical element that projects a feet alignment directional laser line, said first laser being further comprised of a first axial element that enables adjustment of the first laser to provide the feet alignment directional laser line at a desired distance from the device, where said feet alignment directional laser line is aligned with the desired sighting;

a second laser having an optical element that projects a feet to ball laser line that is orthogonal to the feet alignment directional laser line, said second laser being comprised of a second axial element or a common first axial element that enables adjustment of the second laser to provide a reference point for a ball with respect to the feet to ball laser line;

wherein, when the device is positioned in front of a golfer addressing the ball or preparing to address the ball, the feet alignment directional laser line has a length that is at least as long as a width of a golfer's stance; and wherein the feet to ball laser line has a length that is at least as long as a span from the golf ball to the golfer's feet.

2. The golf training device, as claimed in claim 1, wherein said device is further comprised of a third laser having an optical element that projects a lighted line image that is parallel to the feet alignment directional laser line, where the lighted line image is at a desired distance from the device such that it bisects the reference point for the ball.

3. The golf training device, as claimed in claim 1, wherein said device is further comprised of a remote laser light detector module that can measure a speed of a club-head at a point of impact with the golf ball.

4. The golf training device, as claimed in claim 3, wherein said remote laser light detector module can detect when and for how long the vertical arc of light is broken, and based on this data be calibrated to calculate the club-head speed.

5. The golf training device, as claimed in claim 1, wherein said first and second laser are mounted on opposing sides of the housing.

6. The golf training device, as claimed in claim 1, wherein said first and second optical elements are diffraction gradients.

7. The golf training device, as claimed in claim 1, wherein said device is further comprised of a thumbscrew first for tightening the first laser to a set angle.

8. The golf training device, as claimed in claim 7, wherein said device is further comprised of a thumbscrew first for tightening the second laser to a set angle.

9. The golf training device, as claimed in claim 1, wherein said housing is further comprised of series of indicia markings that indicate the angle of the first laser.

10. The golf training device, as claimed in claim 9, wherein said housing is further comprised of series of indicia markings that indicate the angle of the second laser.

11. The golf training device, as claimed in claim 1, wherein said foot to ball laser line is a static reference position that indicates the relative position of the ball with respect to the reference line, and therein the relative position to the golfer's feet.

12. A golf training device for assisting a golfer in sighting a direction for hitting a golf ball, and for assisting the golfer in aligning his body with respect to the ball, where said device comprises:

a housing for mounting at least two lasers, said housing comprised of a vertical element that provides vertical support for the at least two lasers, a base element that enables at least a portion of the housing to be oriented to a desired sighting, and a spike for stabilizing the housing;

a first laser having an optical element that projects a feet alignment directional laser line, said first laser being further comprised of a first axial element that enables adjustment of the first laser to provide the feet alignment directional laser line at a desired distance from the device, where said feet alignment directional laser line is aligned with the desired sighting; and a second laser having an optical element that projects a feet to ball laser line that is orthogonal to the feet alignment directional laser line, said second laser being comprised of a second axial element or a common first axial element that enables adjustment of the second laser to provide a reference point for a ball with respect to the feet to ball laser line.

13. A golf training device for assisting a golfer in sighting a direction for hitting a golf ball, and for assisting the golfer in aligning his body with respect to the ball, where said device comprises:

a housing for mounting at least two lasers, said housing comprised of a vertical element that provides vertical support for the at least two lasers, a base element that enables at least a portion of the housing to be oriented to a desired sighting, and a spike for stabilizing the housing;

a first laser having an optical element that projects a feet alignment directional laser line, said first laser being further comprised of a first axial element that enables adjustment of the first laser to provide the feet alignment directional laser line at a desired distance from the device, where said feet alignment directional laser line is aligned with the desired sighting;

a second laser having an optical element that projects a feet to ball laser line that is orthogonal to the feet alignment directional laser line, said second laser being comprised of a second axial element or a common first axial element that enables adjustment of the second laser to provide a reference point for a ball with respect to the feet to ball laser line; and wherein said first and second optical elements are diffraction gradients.

14. The golf training device, as claimed in claim 12, wherein said device is further comprised of a third laser having an optical element that projects a lighted line image that is parallel to the feet alignment directional laser line, where the lighted line image is at a desired distance from the device such that it bisects the reference point for the ball.

15. The golf training device, as claimed in claim 12, wherein said device is further comprised of a remote laser light detector module that can measure a speed of a club-head at a point of impact with the golf ball.

16. The golf training device, as claimed in claim 14, wherein said remote laser light detector module can detect when and for how long the vertical arc of light is broken, and based on this data be calibrated to calculate the club-head speed.

17. The golf training device, as claimed in claim 12, wherein said first and second laser are mounted on opposing sides of the housing.

18. The golf training device, as claimed in claim 12, wherein said first and second optical elements are diffraction gradients.

19. The golf training device, as claimed in claim 12, wherein said device is further comprised of a thumbscrew first for tightening the first laser and second laser to a set angle.

20. The golf training device, as claimed in claim 12, wherein said device is further comprised of a thumbscrew first for tightening the first and second laser to a set angle.

* * * * *